US007046150B2

(12) United States Patent
Shafer

(10) Patent No.: US 7,046,150 B2
(45) Date of Patent: May 16, 2006

(54) ELECTRONIC ARTICLE SURVEILLANCE LABEL WITH FIELD MODULATED DIELECTRIC

(76) Inventor: Gary Mark Shafer, 2469 Northwest 66th Dr., Boca Raton, FL (US) 33496

( * ) Notice: Subject to any disclaimer, the term of this patent is extended or adjusted under 35 U.S.C. 154(b) by 71 days.

(21) Appl. No.: 10/843,276

(22) Filed: May 11, 2004

(65) Prior Publication Data

US 2005/0253723 A1 Nov. 17, 2005

(51) Int. Cl.
*G08B 13/14* (2006.01)

(52) U.S. Cl. ..... 340/572.4; 340/572.2; 235/493

(58) Field of Classification Search ..... 340/572.2, 340/572.4, 572.6; 342/44
See application file for complete search history.

(56) References Cited

U.S. PATENT DOCUMENTS

| | | | | |
|---|---|---|---|---|
| 3,990,065 | A | 11/1976 | Purinton et al. | |
| 4,114,151 | A * | 9/1978 | Denne et al. | 342/44 |
| 4,139,844 | A | 2/1979 | Reeder | |
| 5,406,262 | A * | 4/1995 | Herman et al. | 340/572.2 |
| 6,011,475 | A * | 1/2000 | Herzer | 340/572.6 |
| 6,441,946 | B1 | 8/2002 | Sheridon | |

* cited by examiner

*Primary Examiner*—Benjamin C. Lee
*Assistant Examiner*—Travis Hunnings

(57) ABSTRACT

A method and apparatus for an electronic article surveillance (EAS) label is described. In an embodiment, the EAS label may be a microwave label including a field modulated dielectric material. In an embodiment, the field modulated dielectric material may have a reflection coefficient that may be changed with a modulation signal.

26 Claims, 4 Drawing Sheets

ELECTRONIC ARTICLE SURVEILLANCE LABEL WITH FIELD MODULATED DIELECTRIC

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area.

Desirable properties for an EAS system may include having larger interrogation zones and smaller, more flexible, security tags. These properties, however, are typically inversely proportional. For example, EAS systems using microwave signals typically have wider coverage areas but need larger security tags. Similarly, EAS systems using low frequency signals typically have narrower coverage areas but allow for smaller security tags. Consequently, there may be need for improvements in conventional EAS systems to solve these and other problems.

DESCRIPTION OF SPECIFIC EMBODIMENTS

Figure 1:
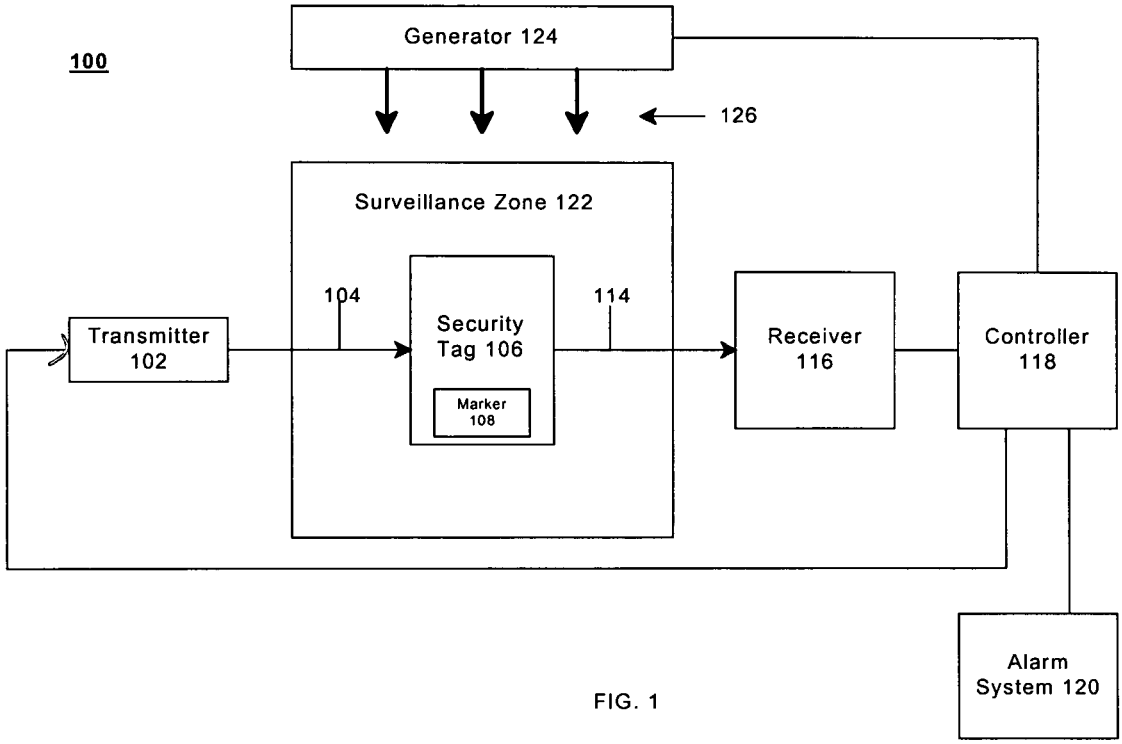
FIG. 1 illustrates a block diagram of a system 100.

FIG. 1 illustrates an EAS system 100. EAS system 100 may comprise monitoring equipment configured to monitor an interrogation zone, such an interrogation zone 122. The monitoring equipment may be configured to detect the presence of a security tag within interrogation zone 122. In one embodiment, EAS system 100 may include a transmitter 102, a security tag 106, a receiver 116, a controller 118, an alarm system 120, and a magnetic field generator 124. Although FIG. 1 shows a limited number of elements, it can be appreciated that any number of additional elements may be used in system 100. The embodiments are not limited in this context.

In one embodiment, EAS system 100 may comprise transmitter 102. Transmitter 102 may comprise any transmitter system configured to transmit an electromagnetic signal, such as a radio frequency (RF) signal operating in the microwave range. The microwave signals may include a 2.45 Gigahertz (GHz) microwave signal or a 915 Megahertz (MHz) microwave signal, for example, although the embodiments are not limited in this context. Transmitter 102 may comprise a transmitter antenna operatively coupled to an output stage, which in turn is connected to a controller, such as controller 118. The output stage may comprise various conventional driving and amplifying circuits, including a circuit to generate a high frequency electric current. When the high frequency electric current is supplied to the transmitter antenna, the transmitter antenna may generate high frequency electromagnetic signals 104 around the transmitter antenna. Electromagnetic signals 104 may propagate into interrogation zone 122. Although electromagnetic signals 104 are described as microwave signals, it may be appreciated that electromagnetic signals 104 may be any RF signals appropriately tuned to operate with security tag 106. The embodiments are not limited in this context.

In one embodiment, EAS system 100 may comprise security tag 106. Security tag 106 may be designed to attach to an item to be monitored. Examples of tagged items may include an article of clothing, a Digital Video Disc (DVD) or Compact Disc (CD) jewel case, a movie rental container, packaging material, and so forth. The embodiments are not limited in this context.

In one embodiment, security tag 106 may include a marker 108. Marker 108 may comprise, for example, a field modulated dielectric material capable of operation at microwave frequencies. More particularly, the field modulated dielectric material of marker 108 may have a reflection coefficient. A reflection coefficient may represent the ratio of the amplitude of a reflected wave and the amplitude of an incident wave. The reflected and incident waves may be created, for example, when electromagnetic signals 104 impinge on marker 108. In one embodiment, the reflection coefficient of the field modulated dielectric material may be changed using a low frequency modulation signal, such as modulation signals 126. Changes in the reflection coefficient may be used to form modulated reply signals 114, as discussed in further detail with reference to FIGS. 2–4.

In one embodiment, marker 108 may be disposed on or within a security tag body or housing for security tag 106. The security tag body may be soft or hard structure designed to support marker 108. Alternatively, the security tag body may be omitted and marker 108 may comprise the entire security tag 106. The embodiments are not limited in this context.

In one embodiment, EAS system 100 may comprise a receiver 116. Receiver 116 may comprise any receiver system configured to receive electromagnetic signals 104 from transmitter 102, as well as modulated reply signal 114 from marker 108. For example, receiver 116 may comprise conventional amplifying and signal-processing circuits, such as band pass filters, mixers and amplifier circuits. In addition, receiver 116 may comprise an output stage connected to controller 118, which is configured to receive and process modulated reply signal 114. The processed signals may then be forwarded to controller 118 to perform detection operations.

In one embodiment, EAS system 100 may comprise generator 124. Generator 124 may be configured to generate an electric field or magnetic field depending on the composition of the field modulated dielectric material selected to implement marker 108. In one embodiment, for example, generator 124 may comprise an e-field generator operating in the 1 Hertz to 100 Kilohertz (KHz) range to form modulations signals 126. In another embodiment, for example, generator 124 may comprise a coil arrangement to generate a low frequency alternating current (AC) magnetic field operating in the 1–10 KHz range to form modulation signals 126. Generator 124 may be configured to generate the electric field or magnetic field with sufficient strength to cover the same area as interrogation zone 122.

In one embodiment, EAS system 100 may comprise controller 118. Controller 118 may comprise a processing and control system configured to manage various operations for EAS system 100. For example, controller 118 may send synchronization signals to transmitter 102. Since marker 108 may be interrogated and detected at a similar frequency used by transmitter 102, the transmitted signals 104 may interfere with the detection of marker 108. Therefore, EAS system 100 may be implemented as a "pulsed system," wherein transmitter 102 and receiver 116 are alternatively turned off and on to reduce interference at receiver 116. The embodiments are not limited in this context.

In one embodiment, controller 118 may receive processed signals from receiver 116. Controller 118 may use the processed signals to determine whether security tag 106 is within interrogation zone 122. For example, modulated reply signal 114 may include a number of detectable sidebands around the center frequency. At least one sideband may be used to determine if security tag 106 is within interrogation zone 122. If security tag 106 is detected within interrogation zone 122, controller 118 may generate a detect signal and forward the signal to alarm system 120.

In one embodiment, EAS system 100 may comprise alarm system 120. Alarm system 120 may comprise any type of alarm system to provide an alarm in response to an alarm signal. The alarm signal may be received from any number of EAS components, such as controller 118. Alarm system 120 may comprise a user interface to program conditions or rules for triggering an alarm. Examples of the alarm may comprise an audible alarm such as a siren or bell, a visual alarm such as flashing lights, or a silent alarm. A silent alarm may comprise, for example, an inaudible alarm such as a message to a monitoring system for a security company. The message may be sent via a computer network, a telephone network, a paging network, and so forth. The embodiments are not limited in this context.

In general operation, transmitter 102 may communicate signals 104 into interrogation zone 122. Generator 124 may send modulation signals 126 into interrogation zone 122. Marker 108 may receive signals 104, and transmit a reply signal at a frequency determined by the product of the two mixing signals as modulated by the reflection coefficient of marker 108. Modulation signal 126 may cause changes in the reflection coefficient of marker 108, thereby modulating the reply signal from marker 108 to form modulated reply signal 114. Receiver 116 may receive modulated reply signal 114, process the signal into electrical current, and forward the processed signal to controller 118. Controller 118 may receive and analyze the signal from receiver 116 to determine whether security tag 106 is within interrogation zone 122.

In one embodiment, transmitter 110, receiver 116 and controller 118 may be elements from a conventional EAS system, such as a Digital Microwave System (DMS) 915 made by Sensormatic® Corporation, as modified using the principles discussed herein. Different EAS systems, however, may also be suitable to implement certain embodiments. The embodiments are not limited in this context.

Figure 2A:
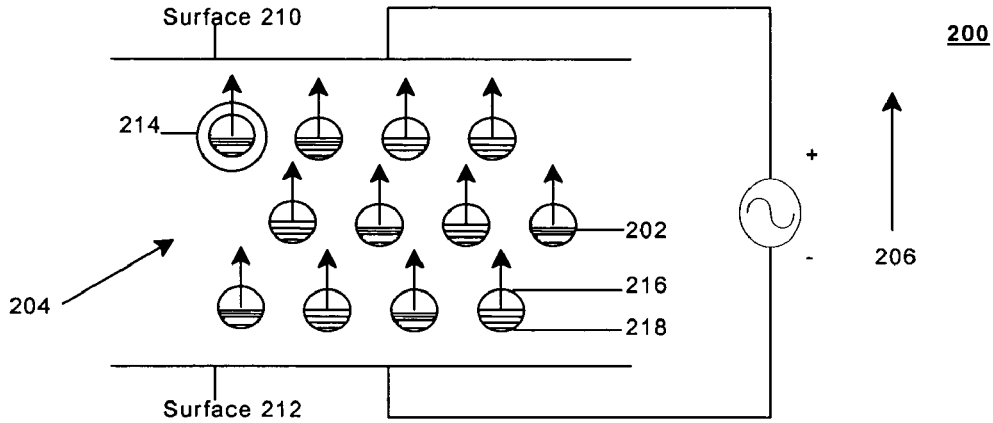
FIGS. 2A–B illustrate diagrams for a marker 200.
Figure 2B:
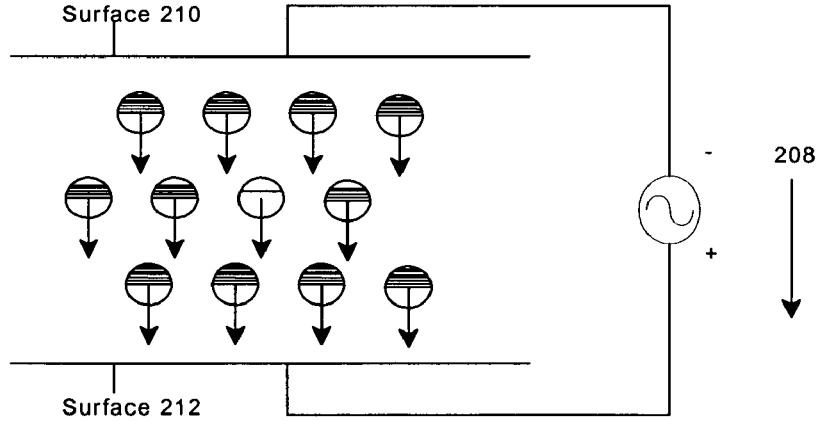

FIGS. 2A and 2B illustrate a pair of diagrams for a marker 200. Marker 200 may be representative of, for example, marker 108. In one embodiment, marker 200 may comprise field modulated dielectric material operatively responsive to RF energy and having a reflection coefficient. Marker 200 may be configured to receive interrogation signal 104 to cause marker 200 to generate a reply signal. Marker 200 may also receive modulation signal 126 to change the reflection coefficient of the field modulated dielectric material in synchrony with modulation signal 126. The change in reflection coefficient may modulate the reply signal to form modulated reply signal 114.

In one embodiment, the field modulated dielectric material for marker 200 may comprise a form of electronic paper. Electronic paper may comprise a display material that has many of the properties of paper. For example, electronic paper may be used to store an image, may be viewed in reflective light, provides a relatively wide viewing angle, and is relatively thin and flexible. Unlike conventional paper, however, electronic paper may be electrically writeable and erasable. A single sheet of electronic paper may be reused to display different text, graphics and images under the control of electrical signals.

FIGS. 2A and 2B illustrate marker 200 as implemented using a first form of electronic paper. In one embodiment, marker 200 may be implemented using a form of electronic paper similar to a "Gyricon" sheet as developed by the Xerox Palo Alto Research Center (PARC). A Gyricon sheet may comprise a large number (e.g., millions) of microspheres 202 embedded within a thin polymer matrix, such as a transparent plastic 204.

In one embodiment, microspheres 202 may be randomly dispersed between surfaces 210 and 212, with each microsphere 202 being contained in a cavity 214. Cavity 214 may comprise an oil-filled cavity to permit each microsphere 202 to freely rotate within cavity 214. Microspheres 202 may be "bichromal" with hemispheres being made of material, or coated with material, having at least two different reflection coefficients. The material selected for each hemisphere should have a reflection coefficient that provides a relatively high contrast ratio between the reflection coefficients. The contrast ratio should create a sufficient difference in the reflection coefficients to create detectable modulation sidebands observable on the reflected microwave carrier signal. For example, a first side may comprise a material having a first coefficient that is highly reflective, such as a metal. A second side may comprise a material having a second coefficient that is highly absorptive, such as carbon. In a more specific example, a first side 216 of microsphere 202 may be coated or painted with a white titanium dioxide, while a second side 218 of microsphere 202 may be coated or painted with a black carbon. The specific materials and specific reflection coefficients for a given implementation, however, may vary according to a number of different factors, such as the operating frequencies of the EAS system, the area of the interrogation zone, detection distance, and so forth. The embodiments are not limited in this context.

In one embodiment, microspheres 202 may be rotated by applying an electric field. Microspheres 202 may be charged so they exhibit an electrical dipole. When an electric field is applied to microspheres 202 via corresponding conductors, microspheres 202 may be rotated to present one or the other side to surfaces 210 or 212, respectively. As shown in FIG. 2A, when a first electric field is applied to microspheres 202 they may rotate in a first direction 206 to display the white color having a first reflection coefficient on first side 216 towards surface 210. The position of microspheres 202 may persist until a second electric field is applied to microspheres 202. As shown in FIG. 2B, when the second electric field is applied to microspheres 202 they may rotate in a second direction 208 to display the black color having a second reflection coefficient on second side 218 toward surface 212.

In one embodiment, modulation signal 126 may be used to control the rotation of microspheres 202 of marker 200. The rotation of microspheres 202 may change the optical reflection coefficient of the field modulated dielectric material. Consequently, as signals 104 reflect off of surface 210 and/or surface 212 of marker 200, the changing reflection coefficient may create a modulation sideband around the reflected microwave carrier signal to form modulated reply signal 114. Accordingly, modulated reply signal 114 may be used to detect the presence of marker 200 within interrogation zone 122.

Figure 3:
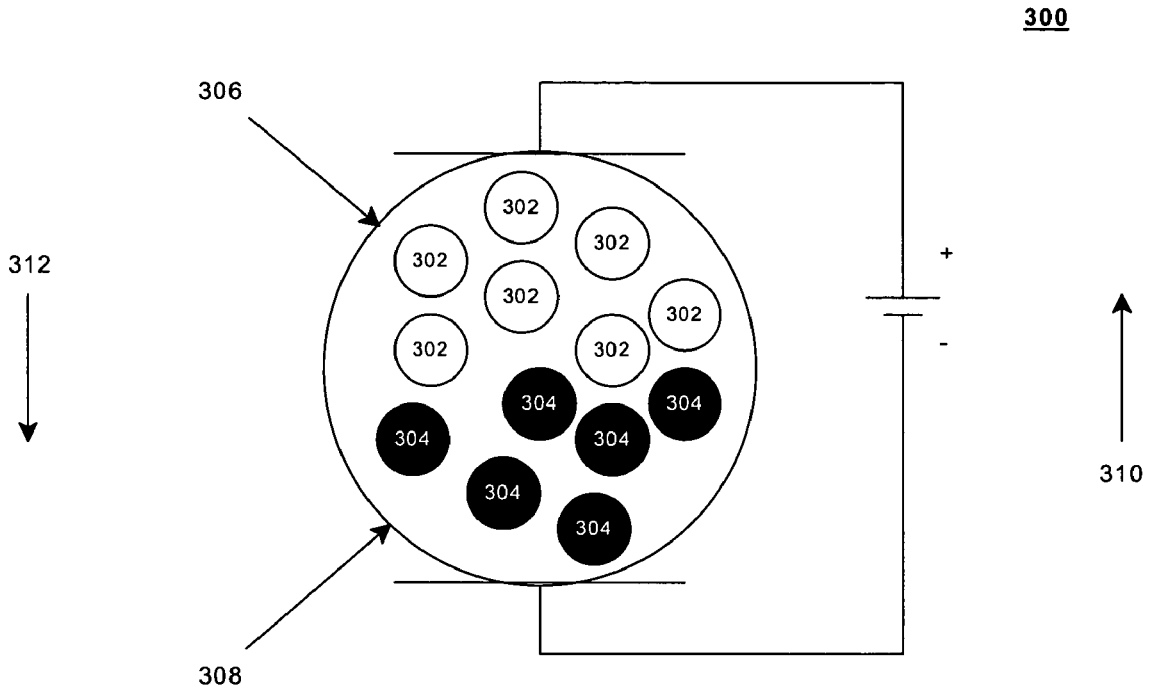
FIG. 3 illustrates a microcapsule 300 for a field modulated dielectric material.

FIG. 3 illustrates a microcapsule to implement marker 200 using a second form of electronic paper. In one embodiment, marker 200 may be implemented using a form of electronic paper similar to an "electrophoretic ink" or "e-ink" sheet as developed by E Ink Corporation. An e-ink sheet is similar in concept to a Gyricon sheet except the e-ink sheet uses non-rotating spheres. Instead, an e-ink sheet may comprise transparent polymer microcapsules 300 containing positively and negatively charged microparticles that each comprise, or are coated, with material having reflection coefficients with a high contrast ratio. For example, positively charged microparticles 302 may comprise white titanium dioxide and negatively charged microparticles 304 may comprise a blue liquid dye. Movement of the microparticles is controlled using electrophoresis, which is the movement imparted by an electric field to charged particles that are suspended in a liquid. When a first electric field is applied to electrodes positioned on the top and bottom of the microcapsules, positively charged particles 302 migrate to the positive electrode in direction 310 and negatively charged particles 304 migrate to the negative electrode in direction 312 thereby displaying the white color microparticles 302 having a first reflection coefficient on a first side 306 of microcapsule 300 and the black color microparticles 304 having a second reflection coefficient on a second side 308 of microcapsule 300. When a second electric field is applied to the electrodes, the reverse occurs, and the positively charged particles 302 migrate to the negative electrode in direction 312 and negatively charged particles 304 migrate to the positive electrode in direction 310 thereby displaying the black color microparticles 304 on first side 306 of microcapsule 300 and the white color microparticles 302 on second side 308 of microcapsule 300.

In one embodiment, modulation signal 126 may be used to control the migration of electrically charged particles of microcapsule 300 for marker 200. The migration of microparticles may change the optical reflection coefficient of the field modulated dielectric material. Consequently, as signals 104 reflect off of surface 210 and/or surface 212 of marker 200, the changing reflection coefficient may create a modulation sideband around the reflected microwave carrier signal to form modulated reply signal 114. Accordingly, modulated reply signal 114 may be used to detect the presence of marker 200 within interrogation zone 122.

Operations for the above system 100 and marker 200 may be further described with reference to the following figures and accompanying examples. Some of the figures may include programming logic. Although such figures presented herein may include a particular programming logic, it can be appreciated that the programming logic merely provides an example of how the general functionality described herein can be implemented. Further, the given programming logic does not necessarily have to be executed in the order presented unless otherwise indicated. In addition, although the given programming logic may be described herein as being implemented in the above-referenced modules, it can be appreciated that the programming logic may be implemented anywhere within the system and still fall within the scope of the embodiments.

Figure 4:
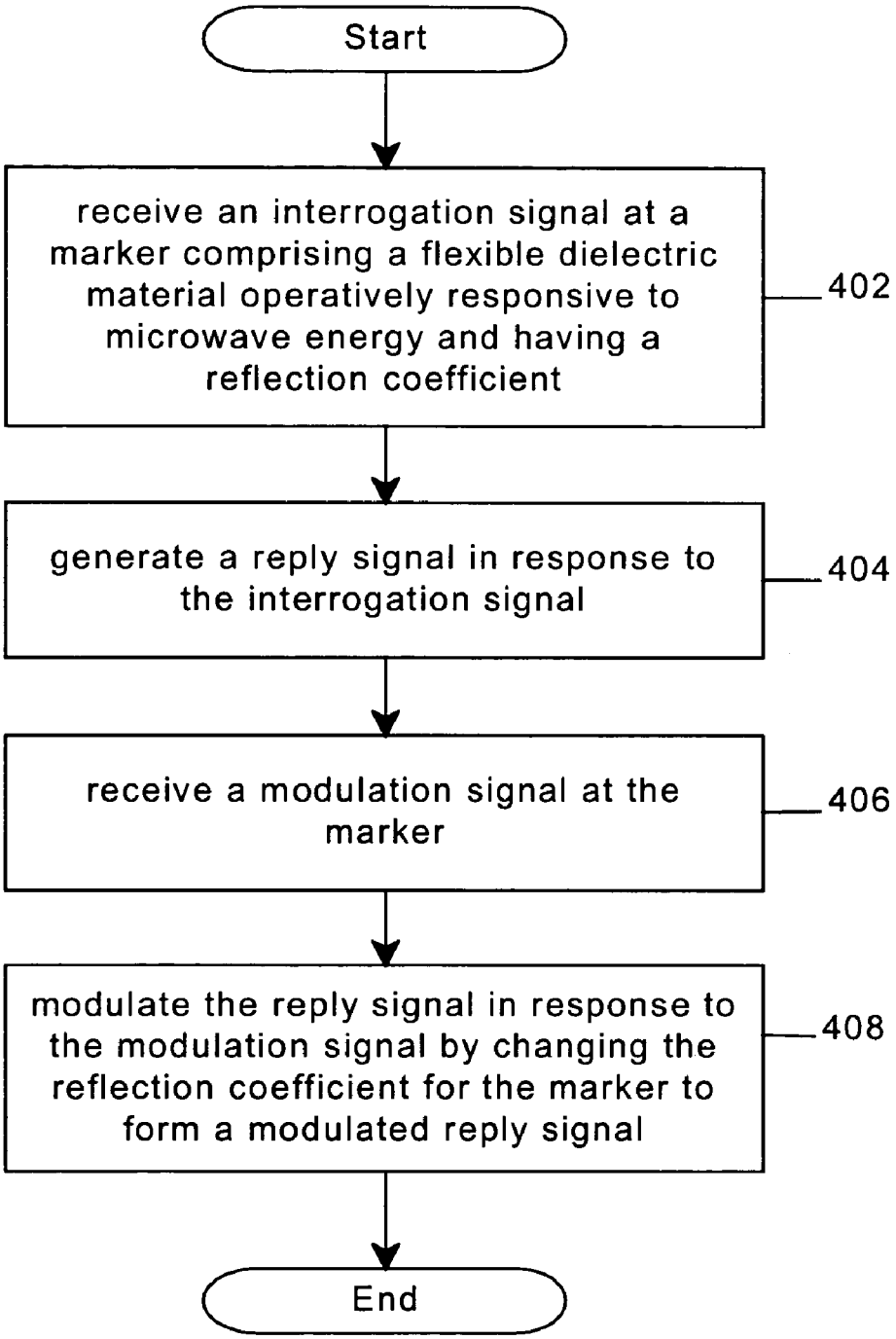
FIG. 4 illustrates a block diagram of a processing logic 400.

FIG. 4 illustrates a block diagram for a programming logic 400. FIG. 4 illustrates a programming logic 400 that may be representative of the operations executed by one or more systems described herein, such as system 100 and/or marker 200. As shown in programming logic 400, an interrogation signal may be received at a marker comprising a field modulated dielectric material operatively responsive to microwave energy and having a reflection coefficient at block 402. A reply signal may be generated in response to the interrogation signal at block 404. A modulation signal may be received at the marker at block 406. The reply signal may be modulated in response to the modulation signal by changing the reflection coefficient for the marker to form a modulated reply signal at block 408.

In one embodiment, the modulation signal creates a first electric field, and the modulating comprises rotating a plurality of microspheres within the field modulated dielectric material in a first direction to display a first reflection coefficient on a first side in response to the first electric field. In one embodiment, the modulation signal creates a second electric field, and the modulating comprises rotating the plurality of microspheres in a second direction to display a second reflection coefficient on a second side in response to the second electric field. The first reflection coefficient and second reflection coefficient may modulate the reply signal to form the modulated reply signal.

In one embodiment, the modulation signal may cause the marker to create a first electric field, and the modulating comprises moving positively charged microparticles to a positive electrode of a microcapsule and negatively charged microparticles to a negative electrode of the microcapsule to display a first reflection coefficient on a first side of the microcapsule and a second reflection coefficient on a second side of the microcapsule in response to the first electric field. In one embodiment, the modulation signal may cause the marker to create a second electric field, and the modulating comprises moving the positively charged microparticles to the negative electrode and the negatively charged microparticles to the positive electrode to display the second reflection coefficient on the first side and the first reflection coefficient on the second side in response to the second electric field. The first reflection coefficient and second reflection coefficient may modulate the reply signal to form the modulated reply signal.

In the case where modulation is performed using an electric field, there may be several ways to provide coupling of the external modulating field into the field modulated dielectric material. Electrodes could be printed in rows and columns in a screen pattern either single-sided or on both sides of the field modulated dielectric material. Alternatively, a spiral inductor pattern might be used if the modulating field occurred at the Radio-Frequency (RF) range, such as 8 to 15 MHz. The electric field would exist between the turns of the inductor.

In the case where modulation is performed using a magnetic field, there would be no need for a printed conductor pattern. In this case, the film alone would provide all the required properties for detection.

In one embodiment, the principles discussed herein may be applied in a Radio-Frequency Identification (RFID) system. For example, an RFID chip may be connected to a spiral inductor and receive its power from an external RF field operating at approximately 13.56 MHz, for example. The RFID chip would then modulate the microwave properties of the material to provide a coded signal over a relatively long range.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

All or portions of an embodiment may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a processor. In another example, an embodiment may be implemented as dedicated hardware, such as a circuit, an application specific integrated circuit (ASIC), Programmable Logic Device (PLD) or digital signal processor (DSP), and so forth. In yet another example, an embodiment may be implemented by any combination of programmed general-purpose computer components and custom hardware components. The embodiments are not limited in this context.

The invention claimed is:

1. A security tag, comprising: a marker comprising a field modulated dielectric material operatively responsive to radio frequencies and having a reflection coefficient, said field modulated dielectric material including a plurality of microspheres or a plurality of microcapsules, said marker to receive an interrogation signal to cause said marker to generate a reply signal, said marker to receive a modulation signal to change said reflection coefficient of said field modulated dielectric material in synchrony with said modulation signal to modulate said reply signal to form a modulated reply signal.

2. The security tag of claim 1, wherein said microspheres are embedded within a polymer matrix, said microspheres to rotate within said polymer matrix in response to said modulation signal, with each microsphere having a first reflection coefficient on a first side and a second reflection coefficient on a second side.

3. The security tag of claim 2, wherein said modulation signal creates a first electric field and second electric field, said first electric field to cause said microspheres to rotate in a first direction to display said first reflection coefficient on said first side, and said second electric field to cause said microspheres to rotate in a second direction to display said second reflection coefficient on said second side.

4. The security tag of claim 3, wherein said reply signal is modulated to form said modulated reply signal in accordance with said rotation.

5. The security tag of claim 1, each microcapsule further comprising: a positive electrode on a first side and a negative electrode on a second side; and, positively charged microparticles having a first reflection coefficient and negatively charged microparticles having a second reflection coefficient.

6. The security tag of claim 5, wherein said modulation signal causes said marker to create a first electric field and a second electric field, said first electric field to cause said positively charged microparticles to migrate to said positive electrode and said negatively charged microparlicles to migrate to said negative electrode thereby displaying said first reflection coefficient on said first side and said second reflection coefficient on said second side, and said second electric field to cause said positively charged microparticles to migrate to said negative electrode and said negatively charged microparticles to migrate to said positive electrode thereby displaying said second reflection coefficient on said first side and said first reflection coefficient on said second side.

7. The security tag of claim 6, wherein said reply signal is modulated to form said modulated reply signal in accordance with said migration.

8. The security tag of claim 1, wherein said interrogation signal comprises one of a 2.45 Gigahertz microwave signal and 915 Megahertz microwave signal.

9. The security tag of claim 1, wherein said modulation signal comprises an electrical field signal with a frequency between 1 Hertz to 100 Kilohertz.

10. The security tag of claim 1, wherein said interrogation signal is an electromagnetic first signal within a first frequency range .DELTA.f1, and said modulation signal is a magnetic second signal within a second frequency range .DELTA.f2, where .DELTA.f1>>.DELTA.f2, and said modulated reply signal is an electromagnetic third signal composed by said first signal, an amplitude of which is modulated by said second signal.

11. The security tag of claim 1, wherein said interrogation signal is an electromagnetic first signal within a first frequency range .DELTA.f1, and said modulation signal is a magnetic second signal within a second frequency range .DELTA.f2, where .DELTA.f1>>.DELTA.f2, and said modulated reply signal is an electromagnetic third signal composed by said first signal, a frequency of which is modulated by said second signal.

12. A system, comprising: a transmitter to transmit an interrogation signal within an interrogation zone; a generator to generate a modulation signal; a security tag to receive said interrogation signal and said modulation signal, said security tag comprising a marker comprising a field modulated dielectric material having a reflection coefficient, said field modulated dielectric material including a plurality of microspheres or a plurality of microcapsules, said marker to generate a reply signal in response to said interrogation signal, and to change said reflection coefficient of said field modulated dielectric material in synchrony with said modulation signal to modulate said reply signal to form a modulated reply signal; a receiver to receive said modulated reply signal; and a controller to detect said security tag within said interrogation zone and output a detect signal.

13. The system of claim 12, further comprising an alarm system to couple to said controller, said alarm system to receive said detect signal and generate an alarm in response to said detect signal.

14. The system of claim 12, wherein said microspheres are embedded within a polymer matrix, said microspheres to rotate within said polymer matrix in response to said modulation signal, wit each microsphere having a first reflection coefficient on a first side and a second reflection coefficient on a second side.

15. The system of claim 14, wherein said modulation signal creates a first electric field and second electric field, said first electric field to cause said microspheres to rotate in a first direction to display said first reflection coefficient on said first side, and said second electric field to cause said microspheres to rotate in a second direction to display said second reflection coefficient on said second side.

16. The system of claim 15, wherein said reply signal is modulated to form said modulated reply signal in accordance with said rotation.

17. The system of claim 12, each microcapsule further comprising: a positive electrode on a first side and a negative electrode on a second side; and, positively charged microparticles having a first reflection coefficient and negatively charged microparticles having a second reflection coefficient.

18. The system of claim 17, wherein said modulation signal causes said marker to create a first electric field and a second electric field, said first electric field to cause said positively charged microparticles to migrate to said positive electrode and said negatively charged microparticles to migrate to said negative electrode thereby displaying said first reflection coefficient on said first side and said second reflection coefficient on said second side, and said second electric field to cause said negatively charged microparticles to migrate to said negative electrode and said negatively charged microparticles to migrate to said positive electrode thereby displaying said second reflection coefficient on said first side and said first reflection coefficient on said second side.

19. The system of claim 18, wherein said reply signal is modulated to form said modulated reply signal in accordance with said migration.

20. The system of claim 12, wherein said interrogation signal comprises one of a 2.45 Gigahertz microwave signal and 915 Megahertz microwave signal.

21. The system of claim 12, wherein said modulation signal comprises an electrical field signal with a frequency between 1 Hertz to 100 Kilohertz.

22. A method, comprising:

receiving an interrogation signal at a marker comprising a field modulated dielectric material operatively responsive to microwave energy and having a reflection coefficient, said field modulated dielectric material including a plurality of microspheres or a plurality of microcapsules;

generating a reply signal in response to said interrogation signal;

receiving a modulation signal at said marker; and modulating said reply signal in response to said modulation signal by changing said reflection coefficient for said marker to form a modulated reply signal.

23. The method of claim 22, wherein said modulation signal creates a first electric field and a second electric field, and said modulating comprises: rotating said microspheres within said field modulated dielectric material in a first direction to display a first reflection coefficient on a first side in response to said first electric field to form a first reflection coefficient; and rotating said microspheres in a second direction to display a second reflection coefficient on a second side in response to said second electric field to form a second reflection coefficient.

24. The method of claim 23, wherein said first reflection coefficient and second reflection coefficient modulates said reply signal to form said modulated reply signal.

25. The method of claim 22, wherein said modulation signal causes said marker to create a first electric field and a second electric field, and said modulating comprises: moving positively charged microparticles to a positive electrode of said microcapsule and said negatively charged microparticles to a negative electrode of said microcapsule to display a first reflection coefficient on a first side of said microcapsule and a second reflection coefficient on a second side of said microcapsule in response to said first electric field to form first reflection coefficient; and moving said positively charged microparticles to said negative electrode and said negatively charged microparticles to said positive electrode to display said second reflection coefficient on said first side and said first reflection coefficient on said second side in response to said second electric field to form a second reflection coefficient.

26. The method of claim 25, wherein said first reflection coefficient and second reflection coefficient modulate said reply signal to form said modulated reply signal.

* * * * *